US011255494B1

(12) United States Patent
Matko

(10) Patent No.: US 11,255,494 B1
(45) Date of Patent: Feb. 22, 2022

(54) COMPACT FLASHLIGHT ASSEMBLY COMPRISING A PRIMARY LIGHT, A BACKUP LIGHT, AND A HANDLE

(71) Applicant: Szabolcs Matko, Debrecen (HU)

(72) Inventor: Szabolcs Matko, Debrecen (HU)

( * ) Notice: Subject to any disclaimer, the term of this patent is extended or adjusted under 35 U.S.C. 154(b) by 0 days.

(21) Appl. No.: 17/358,545

(22) Filed: Jun. 25, 2021

(51) Int. Cl.

| | |
|---|---|
| ***F21L 14/02*** | (2006.01) |
| ***F21V 21/40*** | (2006.01) |
| ***F21V 21/16*** | (2006.01) |
| ***F21V 21/088*** | (2006.01) |
| *F21Y 103/30* | (2016.01) |

(52) U.S. Cl.
CPC ..... *F21L 14/023* (2013.01); *F21V 21/0885* (2013.01); *F21V 21/16* (2013.01); *F21V 21/406* (2013.01); *F21Y 2103/30* (2016.08)

(58) Field of Classification Search
CPC ..... F21V 21/08–0885; F21V 21/406; F21V 21/145; F21L 14/02–023
See application file for complete search history.

(56) References Cited

U.S. PATENT DOCUMENTS

| | | | | |
|---|---|---|---|---|
| 3,030,497 A | | 4/1962 | Cheng | |
| 4,656,566 A | * | 4/1987 | Kelley | A47J 41/0083 16/422 |
| 4,754,379 A | * | 6/1988 | Kelley | A47J 41/0083 215/390 |
| 9,863,622 B1 | | 1/2018 | Armer | |

FOREIGN PATENT DOCUMENTS

| | | | | |
|---|---|---|---|---|
| DE | 102012109648 A1 | * | 4/2014 | F21V 21/406 |
| DE | 202015107069 U1 | * | 1/2016 | F21V 17/002 |
| DE | 202020004851 U1 | * | 12/2020 | F21V 21/406 |

* cited by examiner

*Primary Examiner* — Mariceli Santiago
(74) *Attorney, Agent, or Firm* — Sanchelima & Associates, P.A.; Christian Sanchelima; Jesus Sanchelima

(57) ABSTRACT

A minimal dive light assembly includes two flashlights and a U-shaped handle. One of the flashlights is provided as a primary and the other is provided as a back-up torch. The lights are placed within the upper space of the handle close to each other being fastened to the top bar of the handle by means of fastening devices. In one embodiment, the fastening device may be provided as elastic cords. In another embodiment, the fastening device may be provided as clamps. Auxiliary devices such as a bolt snap, a wrist lanyard, and retractor can be added to the assembly in order to add extra features. Having the lights placed in the upper space of the handle provides a more protected torch light that is less likely to become entangled in ropes.

20 Claims, 11 Drawing Sheets

COMPACT FLASHLIGHT ASSEMBLY COMPRISING A PRIMARY LIGHT, A BACKUP LIGHT, AND A HANDLE

BACKGROUND OF THE INVENTION

1. Field of the Invention

The present invention relates to compact flashlight and, more particularly, to an underwater compact flashlight assembly for scuba divers that comprises a primary light, a backup light, and a handle.

2. Description of the Related Art

Several designs for compact flashlights for scuba divers have been designed in the past. None of them, however, include an underwater compact flashlight assembly for scuba divers that comprises a primary light, a backup light, and a generally U-shaped handle with an adjustable top bar. The lights are placed within the upper space of the handle and are positioned generally parallel and close to each other. Additionally, the lights are fastened to the top bar of the handle by means of fastening devices. These fastening devices may be provided as elastic cords or clamps. Furthermore, auxiliary devices such as bolt snaps, a wrist lanyard, retractor, and other additional elements can be added to the assembly.

It is known that divers making night dives or penetrating caves, caverns, or wrecks often have the need to carry a primary light and a backup light. Typically, the backup light is a handheld and battery powered flashlight that is clipped onto the diving gear or stored in a pocket of the diving suit. The primary light is also a handheld flashlight or canister torch. This means that one of a diver's hand is often always occupied by a flashlight when diving. Therefore, there is a need for a compact flashlight assembly that is fitted with a primary light and a backup light affixed to a U-shaped handle. The compact flashlight assembly allows a diver to carry the flashlight assembly on the dorsal side of the diver's hand in order to free the diver's hand to operate other tools.

Applicant believes that a related reference corresponds to U.S. Pat. No. 9,863,622 issued for an LED underwater light, which can be handheld or mounted on an underwater camera housing which is switchable between two light modes. Applicant believes that another related reference corresponds to U.S. Pat. No. 3,030,497 issued for an electric lantern comprising a battery casing and a plurality of electrical lamp holders containing electric lamps. However, the cited references differ from the present invention because they fail to disclose an underwater compact flashlight assembly for scuba divers that comprises a primary light, a backup light, and a generally U-shaped handle with an adjustable top bar.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide an underwater compact flashlight which eliminates the need for a separate canister or a connector cable in order to increase ease of operation.

It is another object of this invention to provide an underwater compact flashlight which eliminates having lights mounted to opposing side ends of the handle, the lights are mounted to the top end of the handle for a more compact design.

It is still another object of the present invention to provide an underwater compact flashlight which includes both a primary and backup light on the handle there by eliminating the time wasted to find the backup light on the diving gear of a diver.

It is yet another object of this invention to provide such a device that is inexpensive to implement and maintain compared to canister torches while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
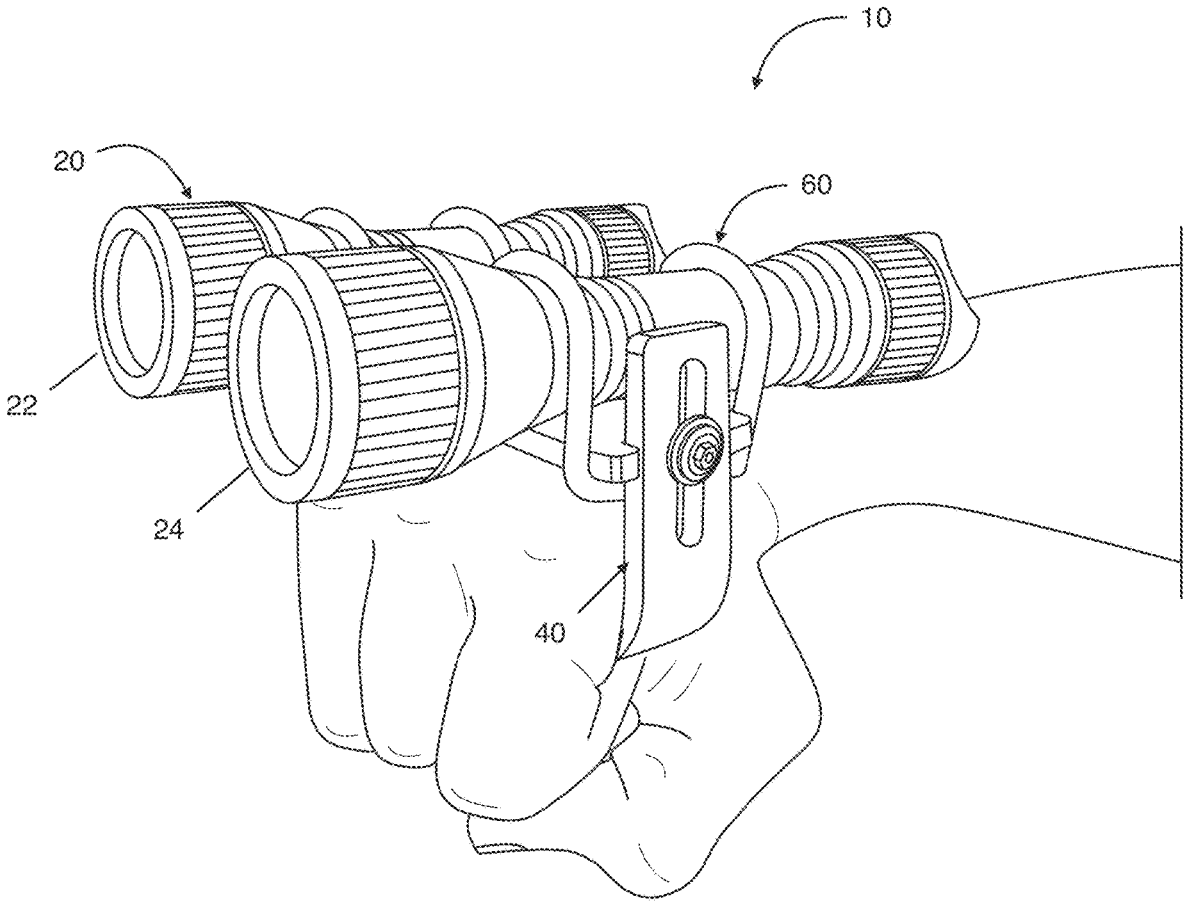
FIG. 1 represents an operational isometric view of compact flashlight 10 in accordance with an embodiment of the present invention.

Referring now to the drawings, where the present invention is generally referred to with numeral 10, it can be observed an underwater compact flashlight 10 which basically includes a light assembly 20, a handle assembly 40, and a mounting assembly 60.

Light assembly 20 includes a primary light 22 and a backup light 24 as observed in FIG. 1 of the provided drawings. In the present embodiment, primary light 22 and backup light 24 are diving lights which are suitable for use in an underwater environment. Additionally, both lights may be provided as having an identical body type such as an elongated cylindrical body type observed in FIG. 1. However, it should be understood that any shape and size for primary light 22 and backup light 24 may be implemented into the present invention.

Figure 2:
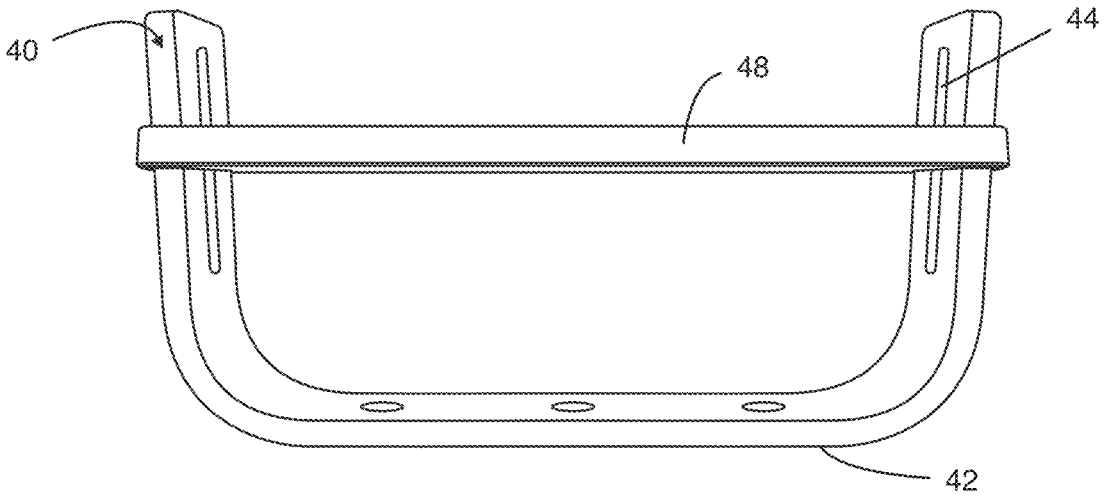
FIG. 2 shows an isometric front view of handle assembly 40 in accordance with an embodiment of the present invention.
Figure 3:
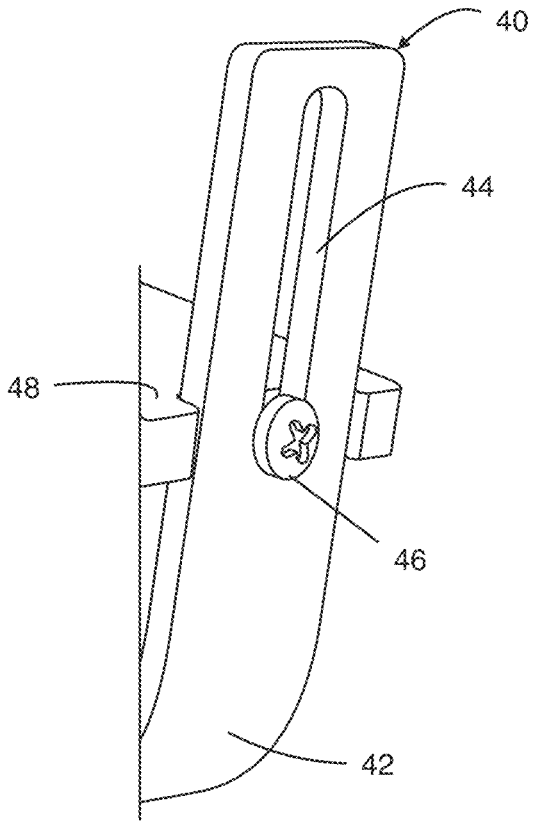
FIG. 3 illustrates an enlarged isometric side view of handle assembly 40 depicting through hole 44 and fastening apparatus 46 in accordance with an embodiment of the present invention.
Figure 4:
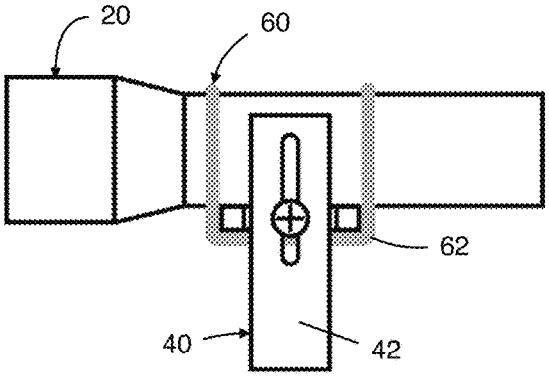
FIG. 4 is a representation of an elevational side view of compact diving light 10 depicting mounting assembly 60 with cords 62 in accordance with a first embodiment of the present invention.
Figure 5:
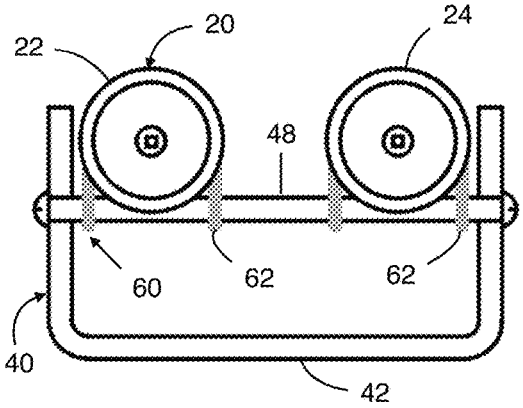
FIG. 5 shows an elevational front view of compact diving light 10 depicting mounting assembly 60 with cords 62 in accordance with a first embodiment of the present invention.
Figure 6:
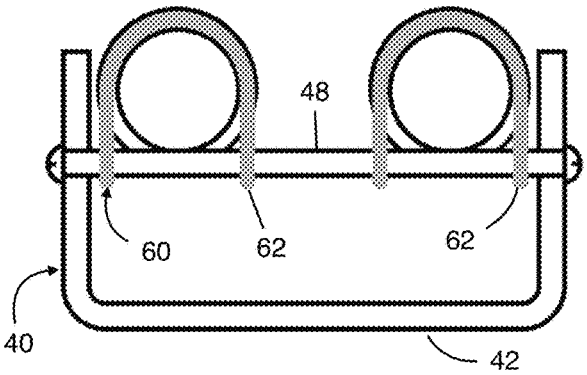
FIG. 6 illustrates an elevational rear view of compact diving light 10 depicting mounting assembly 60 with cords 62 in accordance with a first embodiment of the present invention.
Figure 7:
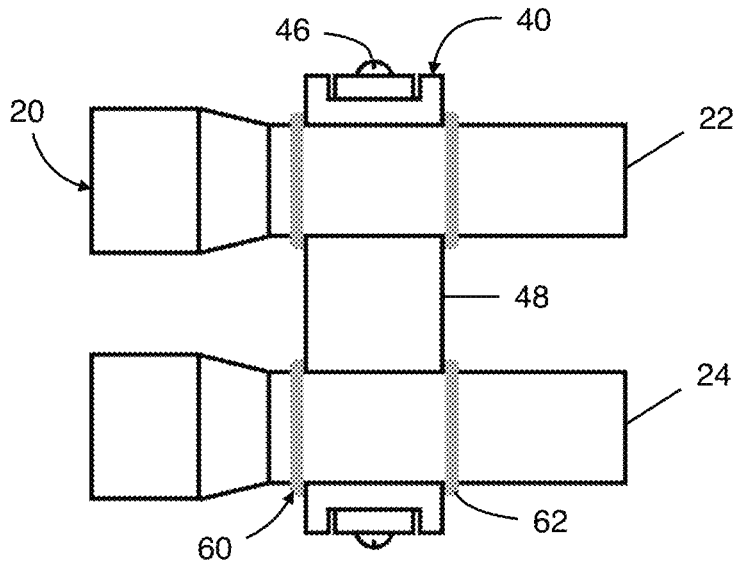
FIG. 7 represents a top plan view of compact diving light 10 depicting mounting assembly 60 with cords 62 in accordance with a first embodiment of the present invention.
Figure 8:
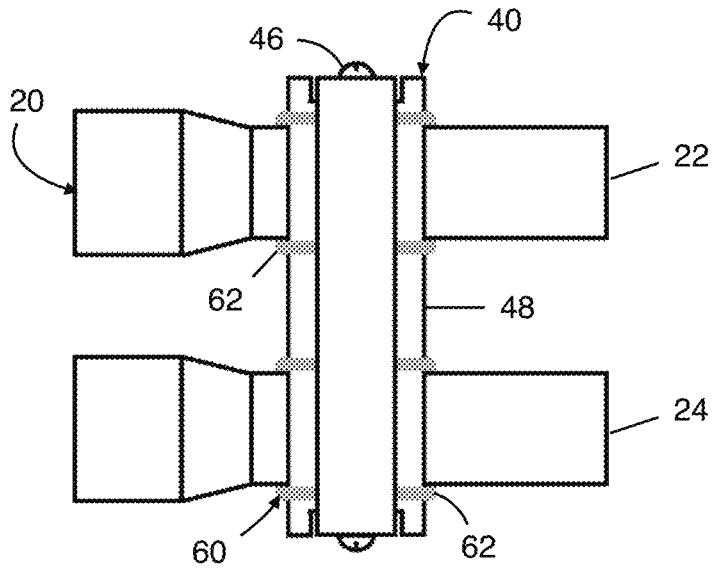
FIG. 8 shows a bottom plan view of compact diving light 10 depicting mounting assembly 60 with cords 62 in accordance with a first embodiment of the present invention.
Figure 9:
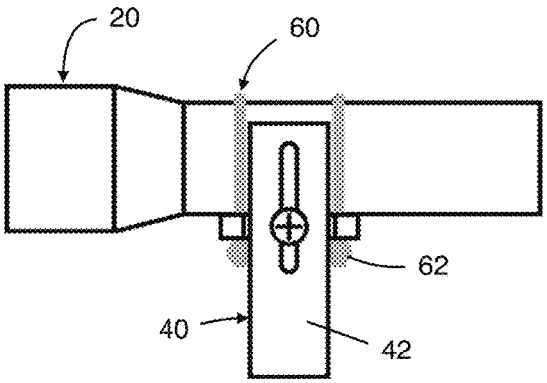
FIG. 9 illustrates an elevational side view of compact diving light 10 depicting mounting assembly 60 with cords 62 fastened with openings 48A in accordance with a second embodiment of the present invention.
Figure 10:
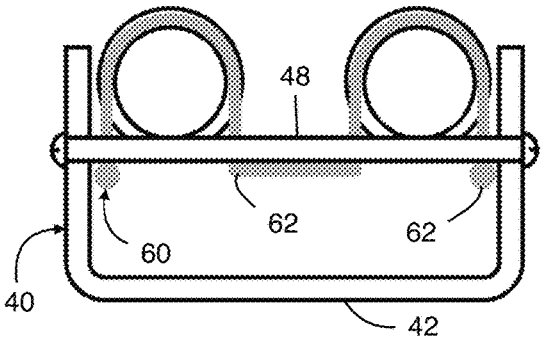
FIG. 10 is a representation of an elevational rear view of compact diving light 10 depicting mounting assembly 60 with cords 62 fastened with openings 48A in accordance with a second embodiment of the present invention.
Figure 11:
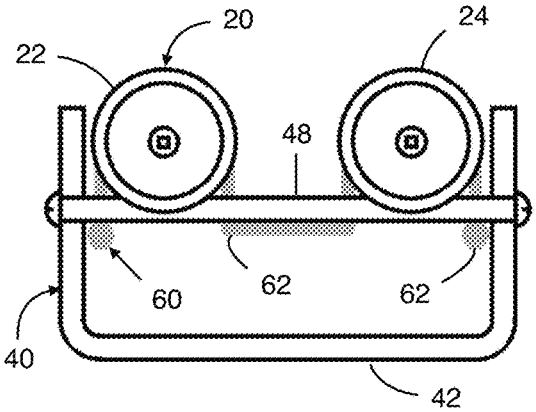
FIG. 11 shows an elevational front view of compact diving light 10 depicting mounting assembly 60 with cords 62 fastened with openings 48A in accordance with a second embodiment of the present invention.
Figure 12:
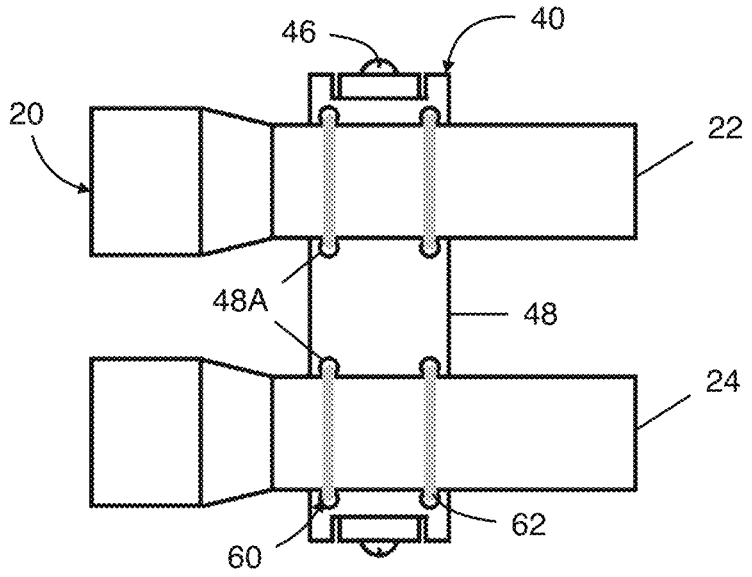
FIG. 12 illustrates a top plan view of compact diving light 10 depicting mounting assembly 60 with cords 62 fastened with openings 48A in accordance with a second embodiment of the present invention.
Figure 13:
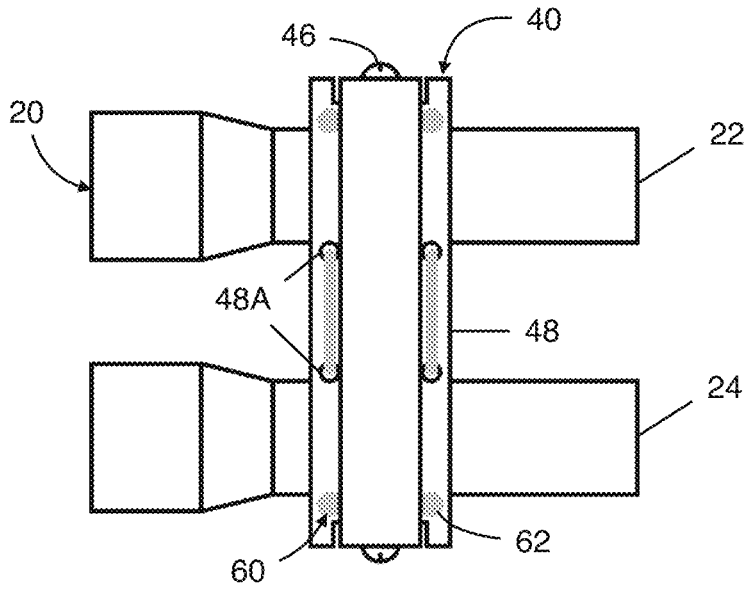
FIG. 13 is a representation of a bottom plan view of compact diving light 10 depicting mounting assembly 60 with cords 62 fastened with openings 48A in accordance with a second embodiment of the present invention.
Figure 14:
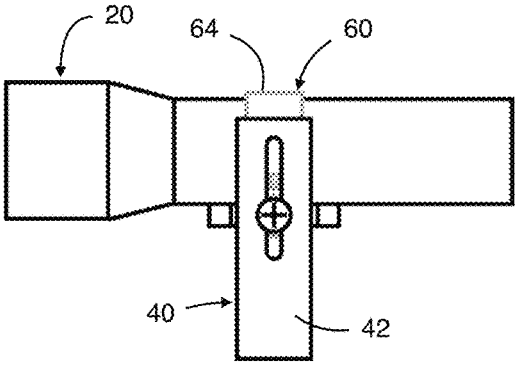
FIG. 14 shows an elevational side view of compact diving light 10 depicting mounting assembly 60 with clamp 64 fastened with bolts 64A and nuts 64B in accordance with a third embodiment of the present invention.

Handle assembly 40 is best observed in FIGS. 2 and 3 of the provided drawings. In one embodiment, handle assembly 40 includes a handle portion 42. Handle portion 42 may be provided as a U-shaped handle with a gripping portion and lateral sidewalls. In the present implementation, the lateral sides of handle portion 42 include through holes 44. As depicted in FIG. 3, through holes 44 may be provided as elongated slot openings which extend partially along the lateral sides of handle portion 42. It should be understood that each of the through holes 44 align with each other respectively when formed onto handle portion 42.

Handle assembly 40 further includes a top bar 48 being operatively mounted to handle portion 42 with fastening apparatus 46 as depicted in FIG. 3. In one embodiment, fastening apparatus 46 is a threaded fastener which is inserted therethrough through holes 44 and engaged with top bar 48. This configuration allows for top bar 48 to be vertically adjusted along through holes 44. A user may utilize fastening apparatus 46 to loosen top bar 48 and then position the top bar at a desired height along through holes 44.

Mounting assembly 60 includes cords 62 in accordance with a first embodiment of the invention observed in FIGS. 4-8. In the first embodiment, mounting assembly 60 is provided with two cords 62 in order to fasten and secure light assembly 20 onto handle assembly 40. Cords 62 may be provided as elastic cords or bungee cords with a suitable elasticity to safely secure each of the primary light 22 and the backup light 24 onto top bar 48. As observed in the figures, each of cords 62 is provided in a closed loop and secured onto the light assembly 20. Cord 62 is wrapped around a front end of each of the primary light 22 and the backup light 24. Afterwards, cord 62 is then fed through the center opening formed between the top bar 48 and the handle portion 42. Once fed therethrough, cord 62 is then secured to a rear end of each of the lights. The elastic potential energy within the cords 62 results in a force securing each of the lights along top bar 48. The first embodiment allows for each of the primary light 22 and the backup light 24 to be easily mounted to and removed from the top bar 48.

Mounting assembly 60 includes cords 62 in accordance with a second embodiment of the invention observed in FIGS. 9-13. In the second embodiment, mounting assembly 60 is provided with two cords 62 in order to fasten and secure light assembly 20 onto handle assembly 40. Cords 62 may be provided as elastic cords or bungee cords with a suitable elasticity to safely secure each of the primary light 22 and the backup light 24 onto top bar 48. Additionally, cords 62 are provided as a linear cord member in the second embodiment as opposed to the closed loop structure of the first embodiment. As observed in the figures, top bar 48 includes openings 48A disposed thereon. In the second embodiment, light assembly 20 is positioned on the top end of top bar 48 and openings 48A are disposed on adjacent side ends of the primary light 22 and secondary light 24. Cords 62 are then fed through openings 48A and positioned over the top end of both primary light 22 and secondary light 24. A knot is then tied along the opposing distal sets of openings 48A along the bottom end of top bar 48. As a result, light assembly 20 remains mounted to the top end of bar 48 due to the elastic potential energy from the cords 62 acting on the primary light 22 and secondary light 24.

Figure 15:
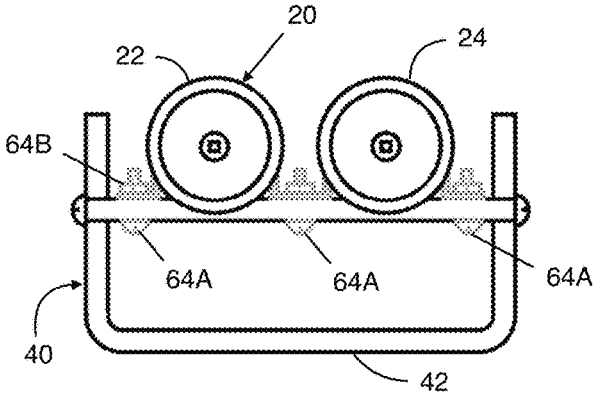
FIG. 15 illustrates an elevational front view of compact diving light 10 depicting mounting assembly 60 with clamp 64 fastened with bolts 64A and nuts 64B in accordance with a third embodiment of the present invention.
Figure 16:
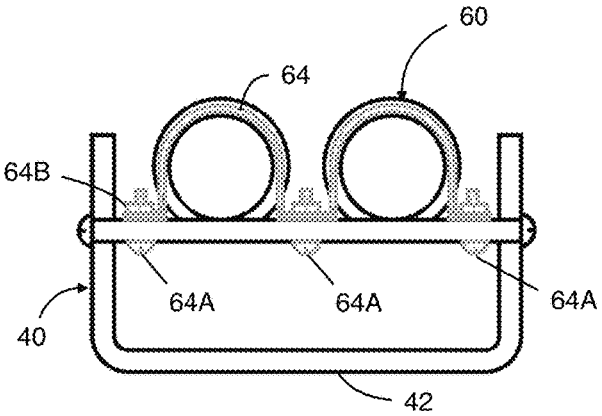
FIG. 16 represents an elevational rear view of compact diving light 10 depicting mounting assembly 60 with clamp 64 fastened with bolts 64A and nuts 64B in accordance with a third embodiment of the present invention.
Figure 17:
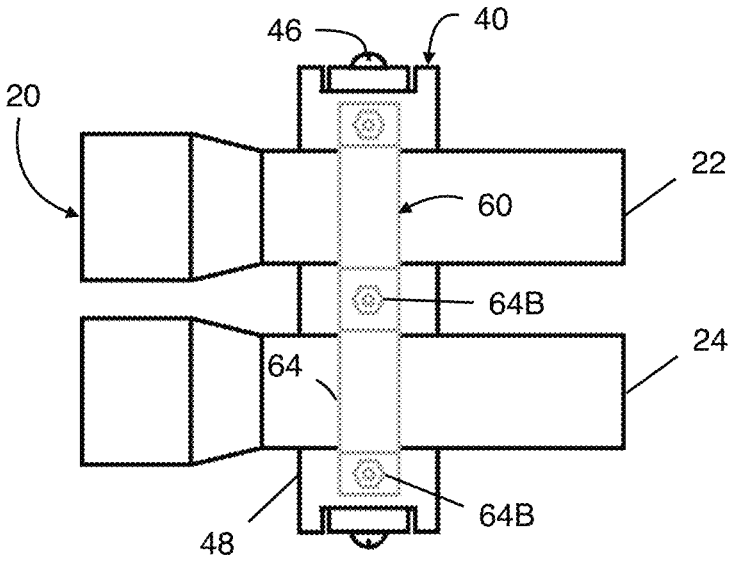
FIG. 17 shows a top plan view of compact diving light 10 depicting mounting assembly 60 with clamp 64 fastened with bolts 64A and nuts 64B in accordance with a third embodiment of the present invention.
Figure 18:
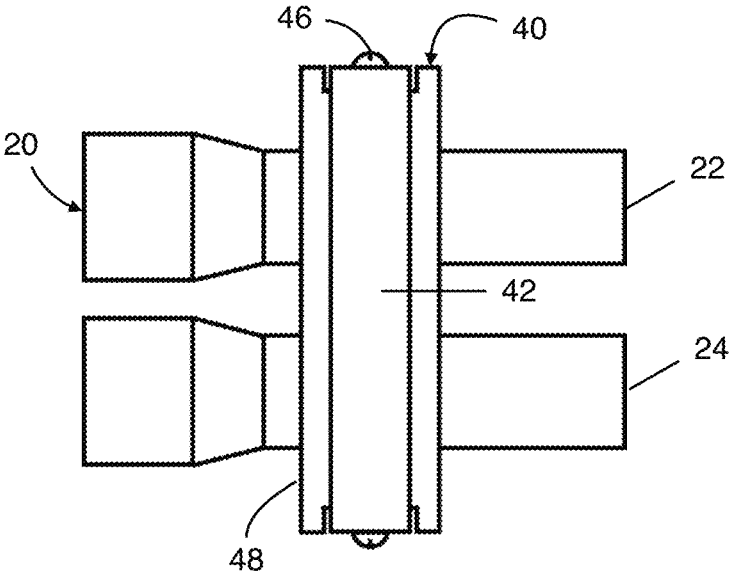
FIG. 18 illustrates a bottom plan view of compact diving light 10 depicting mounting assembly 60 with clamp 64 fastened with bolts 64A and nuts 64B in accordance with a third embodiment of the present invention.

Mounting assembly 60 includes a clamp member 64 in accordance with a third embodiment of the invention observed in FIGS. 14-18. In the third embodiment, clamp member 64 is provided as a singular clamping structure with two concave portions to be fitted onto the top end of the light assembly 20. As observed in the figures, primary light 22 and back up light 24 is positioned on the top end of top bar 48. Clamp 64 is then mounted onto the top end of the top bar 48 and the lights are fitted within the concave portions of the clamp 64. In the present embodiment, clamp 64 includes bolts 64A and nuts 64B in order to engage clamp 64 to top bar 48 in an abutting configuration. Bolts 64A may be provided as a threaded fastener that is threadably mounted to clamp 64 from a bottom end of top bar 48 as seen in FIG. 15. Nuts 64B are then mounted to the bolts 64A from the top end of top bar 48. As a result, light assembly 20 remains securely mounted onto the top bar 48. Compared to the first and second embodiments, the third embodiment allows for a more secure engagement means when securing the light assembly 20 to the handle assembly 40.

Figure 19:
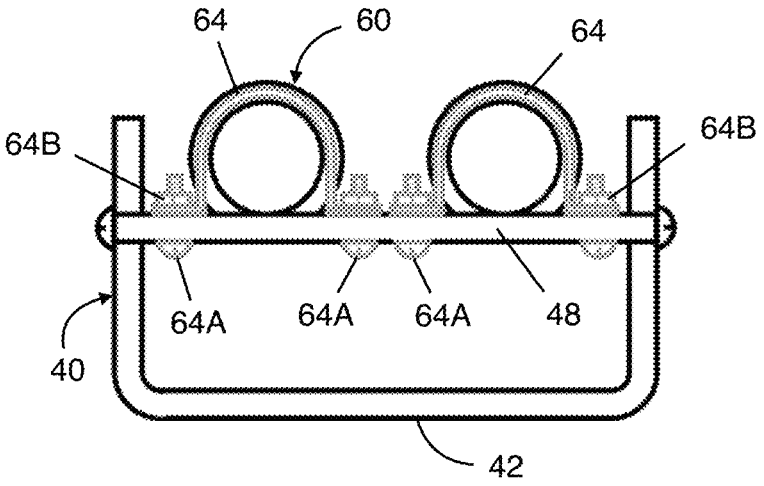
FIG. 19 is a representation of an elevational rear view of compact diving light 10 depicting mounting assembly 60 with clamps 64 fastened with bolts 64A and nuts 64B in accordance with a fourth embodiment of the present invention.
Figure 20:
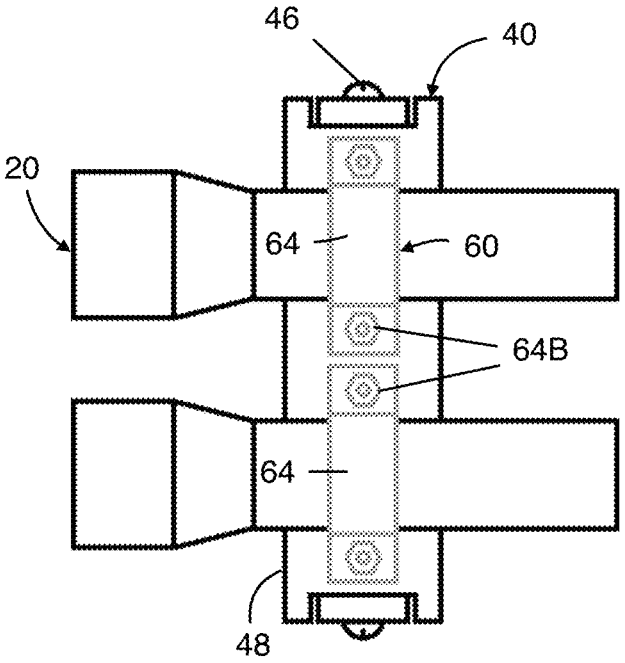
FIG. 20 shows a top plan view of compact diving light 10 depicting mounting assembly 60 with clamps 64 fastened with bolts 64A and nuts 64B in accordance with a fourth embodiment of the present invention.
Figure 21:
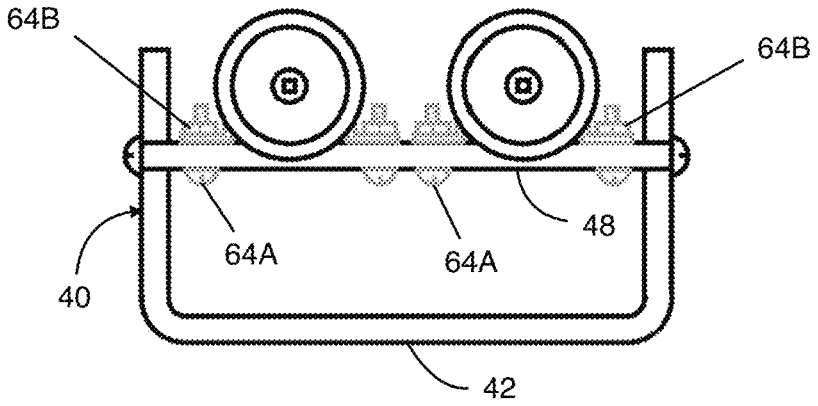
FIG. 21 illustrates an elevational front view of compact diving light 10 depicting mounting assembly 60 with clamps 64 fastened with bolts 64A and nuts 64B in accordance with a fourth embodiment of the present invention.

Mounting assembly 60 includes at least two clamp members 64 in accordance with a fourth embodiment of the invention observed in FIGS. 19-21. In the fourth embodiment, a clamp member 64 is provided for each of the primary light 22 and secondary light 24 resulting in at least two clamp members 64. Each of the clamp members 64 includes a concave portion which receives the lights therein. In the present embodiment, clamps 64 are provided with bolts 64A and nuts 64B in order to engage clamps 64 onto top bar 48 in an abutting configuration. Bolts 64A may be provided as a threaded fastener that is threadably mounted to clamps 64 from a bottom end of top bar 48 as seen in FIG. 19. Nuts 64B are then mounted to the bolts 64A from the top end of top bar 48. As a result, light assembly 20 remains securely mounted onto the top bar 48. This fourth embodiment allows for a user to selectively engage each of the primary light 22 and the secondary light 24 when being mounted onto the handle assembly 40.

Figure 22:
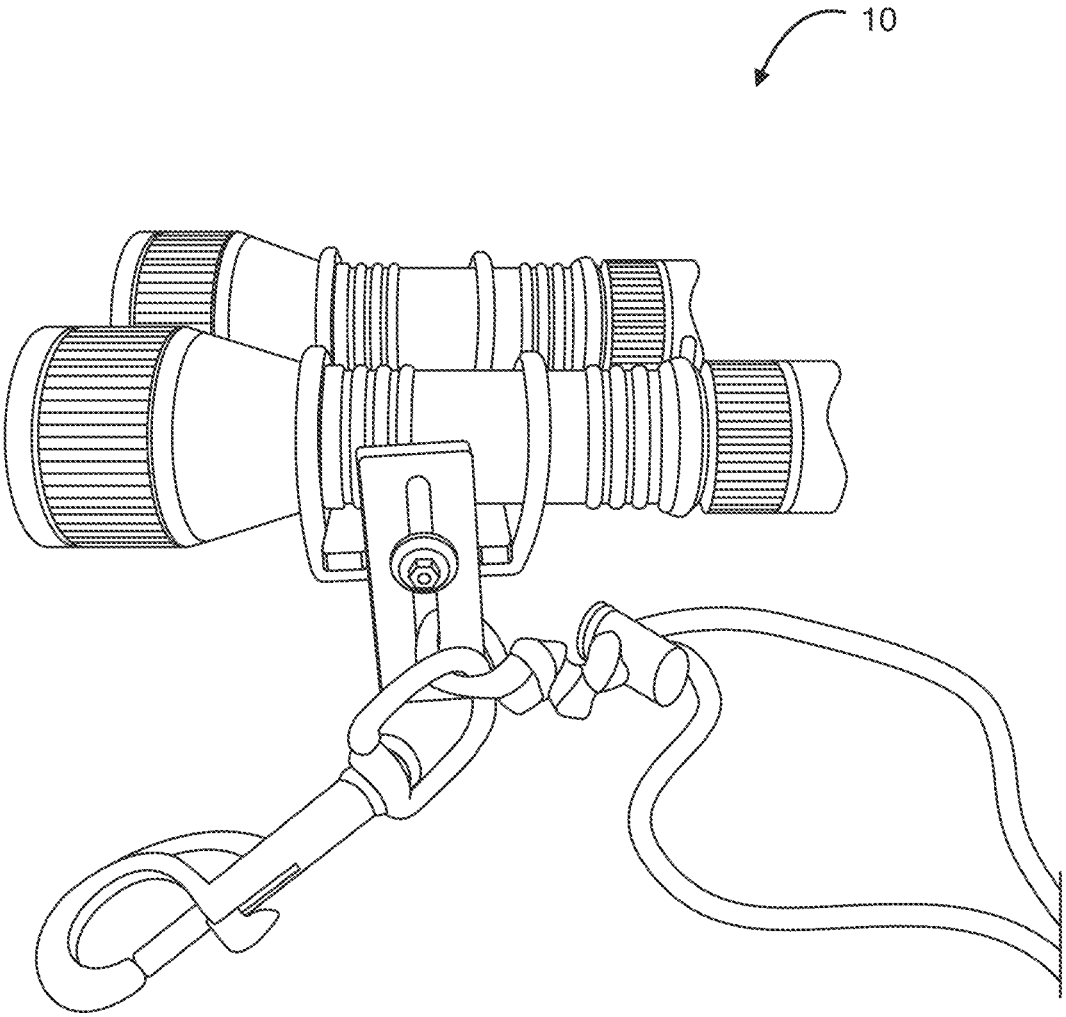
FIG. 22 represents an isometric view of compact diving light 10 with additional features including a wrist lanyard and a bolt snap in accordance with another embodiment of the present invention.

Other embodiments of the present invention may include auxiliary parts further fitted onto the compact diving light 10 as observed in FIG. 22 of the drawings. These auxiliary parts may include a wrist lanyard which may be provided as a conventional cord usually made from plastic that allows to attach the compact diving light to the diver's wrist and prevents the compact diving light from being lost. Additionally, the auxiliary parts may include a bolt snap that allows to clip the compact diving light to attachment points located on the dive gear. Furthermore, the auxiliary parts may also include a retractor that allows to clip the compact light assembly to attachments points on the dive gear and prevents it from being lost when diving. It should be understood that other auxiliary parts may be fitted onto the compact diving light 10.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A compact diving light, comprising:
a) a light assembly including a primary light and a secondary light;
b) a handle assembly including a handle portion having a U-shaped configuration, said handle portion having a grip section and lateral sidewalls, a top bar being adjustably secured on the lateral sidewalls of said handle portion; and
c) a mounting assembly including at least one cord or at least one clamp, wherein said at least one cord or said at least one clamp secures each of the primary light and the secondary light abuttingly onto a top surface of said top bar.

2. The compact diving light of claim 1 wherein said primary light and said secondary light each have a cylindrical shape.

3. The compact diving light of claim 1 wherein said lateral sidewalls of said handle portion includes through holes thereon.

4. The compact diving light of claim 3 wherein said through holes are elongated slot openings which extend partially along the lateral sides of said handle portion.

5. The compact diving light of claim 4 wherein said top bar is secured to the lateral sidewalls with a fastening apparatus.

6. The compact diving light of claim 1 wherein said primary light and said secondary light are positioned parallel to each other when mounted onto said top bar.

7. The compact diving light of claim 1 wherein said top bar further includes openings located thereon.

8. The compact diving light of claim 7 wherein said at least one cord is inserted through said opening to secure said light assembly to said top bar, wherein a knot is formed on the at least one cord from a bottom end of said top bar, said at least one cord then extending abuttingly over a top end of said light assembly.

9. The compact diving light of claim 1 wherein said at least one cord is a closed loop cord.

10. The compact diving light of claim 1 wherein said at least one clamp includes concave portions to receive said light assembly.

11. The compact diving light of claim 10 wherein said at least one clamp is in abutting engagement with the top surface of said top bar.

12. The compact diving light of claim 11 wherein said at least one clamp includes bolts and nuts.

13. The compact diving light of claim 12 wherein said bolts are mounted from a bottom surface of said top bar and extend upwardly through the top bar to engage with the at least one clamp.

14. The compact diving light of claim 13 wherein said nuts are secured onto the bolts from a top end of said top bar.

15. A system for a compact diving light, comprising:
a) a light assembly including a primary light and a secondary light;
b) a handle assembly including a handle portion having a U-shaped configuration, said handle portion having a grip section and lateral sidewalls, a top bar being adjustably secured on the lateral sidewalls of said handle portion, wherein said lateral sidewalls include through holes located thereon, wherein said through holes are elongated slot openings which extend partially along the lateral sides of said handle portion, said handle assembly further including a fastening apparatus which is inserted through said through holes and is threadably engaged with side ends of the top bar, said top bar being adjustable along said through holes of the lateral sidewalls, wherein said top bar further includes openings thereon; and
c) a mounting assembly including at least one cord or at least one clamp, wherein said at least one cord or said at least one clamp secures each of the primary light and the secondary light abuttingly onto a top surface of said top bar, wherein said at least one clamp includes at least two concave portions to receive said primary light and said secondary light, wherein said at least one cord is one of a closed loop or a linear cord strand.

16. The system for a compact diving light of claim 15 wherein said at least one clamp includes bolts and nuts.

17. The system for a compact diving light of claim 16 wherein said bolts are mounted from a bottom surface of said top bar and extend upwardly through the top bar to engage with the at least one clamp.

18. The system for a compact diving light of claim 17 wherein said nuts are secured onto the bolts from a top end of said top bar.

19. The system for a compact diving light of claim 15 wherein said at least one cord is inserted through said opening to secure said light assembly to said top bar, wherein a knot is formed on the at least one cord from a bottom end of said top bar, said at least one cord then extending abuttingly over a top end of said light assembly.

20. A compact diving light, consisting of:

a) a light assembly including a primary light and a secondary light;

b) a handle assembly including a handle portion having a U-shaped configuration, said handle portion having a grip section and lateral sidewalls, a top bar being adjustably secured on the lateral sidewalls of said handle portion, wherein said lateral sidewalls include through holes located thereon, wherein said through holes are elongated slot openings which extend partially along the lateral sides of said handle portion, said handle assembly further including a fastening apparatus which is inserted through said through holes and is threadably engaged with side ends of the top bar, said top bar being adjustable along said through holes of the lateral sidewalls, wherein said top bar further includes openings thereon; and c) a mounting assembly including at least one cord or at least one clamp, wherein said at least one cord or said at least one clamp secures each of the primary light and the secondary light abuttingly onto a top surface of said top bar, wherein said at least one clamp includes at least two concave portions to receive said primary light and said secondary light, wherein said at least one clamp includes bolts and nuts, wherein said bolts are mounted from a bottom surface of said top bar and extend upwardly through the top bar to engage with the at least one clamp, wherein said nuts are secured onto the bolts from a top end of said top bar, wherein said at least one cord is a linear cord strand, wherein said at least one cord is inserted through said opening to secure said light assembly to said top bar, wherein a knot is formed on the at least one cord from a bottom end of said top bar, said at least one cord then extending abuttingly over a top end of said light assembly.

* * * * *